US008012033B2

(12) United States Patent
Novosel, Sr.

(10) Patent No.: US 8,012,033 B2
(45) Date of Patent: Sep. 6, 2011

(54) GOLF SWING TRAINER APPARATUS AND METHOD

(76) Inventor: John Michael Novosel, Sr., Leawood, KS (US)

( * ) Notice: Subject to any disclaimer, the term of this patent is extended or adjusted under 35 U.S.C. 154(b) by 549 days.

(21) Appl. No.: 11/973,838

(22) Filed: Oct. 10, 2007

(65) Prior Publication Data

US 2008/0293508 A1 Nov. 27, 2008

Related U.S. Application Data

(60) Provisional application No. 60/854,610, filed on Oct. 25, 2006.

(51) Int. Cl.
*A63B 69/36* (2006.01)

(52) U.S. Cl. ..... 473/226; 473/238; 473/242

(58) Field of Classification Search ..... 473/226, 473/280, 231, 235, 238, 242, 257
See application file for complete search history.

(56) References Cited

U.S. PATENT DOCUMENTS

| | | | | |
|---|---|---|---|---|
| 3,401,941 | A * | 9/1968 | Hesidence | 473/235 |
| 3,721,447 | A * | 3/1973 | Louderback | 473/235 |
| 3,870,316 | A * | 3/1975 | DeBrocke | 473/235 |
| 5,026,064 | A * | 6/1991 | Novosel | 473/235 |
| 5,725,438 | A * | 3/1998 | Dennesen | 473/163 |
| 2008/0102992 | A1 * | 5/2008 | Novosel | 473/425 |

* cited by examiner

*Primary Examiner* — Nini Legesse
(74) *Attorney, Agent, or Firm* — Robert Hunter

(57) ABSTRACT

The subject invention is comprised of a striking member adapted to emulate a specific selected sport, such striking member having removable indicator appendages that enable the user to feel by vibration and replicate by sight where the striking member is during the striking movement, and a target member adapted to emulate the playing object of the same selected sport, the target member including flexible, elongate momentum elements selectively attachable to the target member to provide progressive resistance and accurately simulate the characteristics of an actual ball or playing object.

12 Claims, 5 Drawing Sheets

Fig. 6.
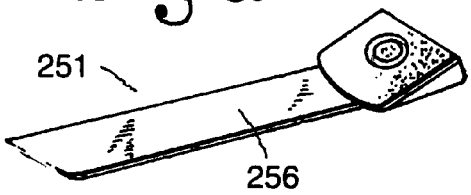
Fig. 7.
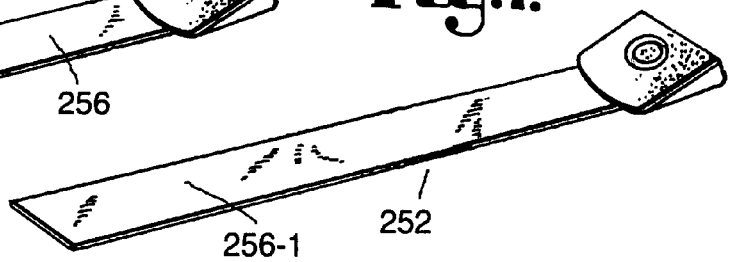
Fig. 8.
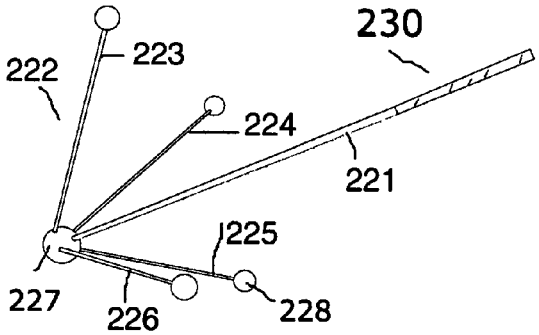
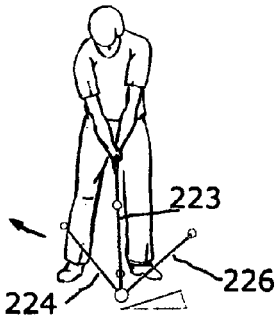
Fig. 9.
Fig. 10.
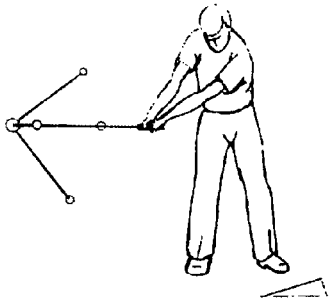
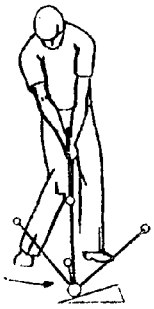
Fig. 11.

Fig.12.
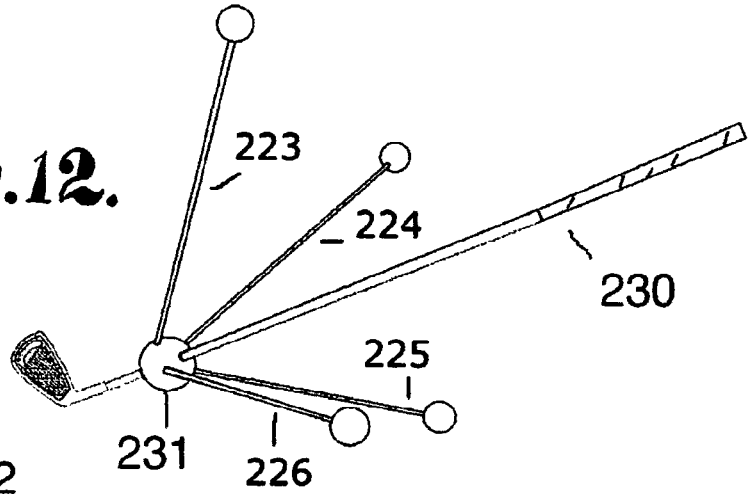
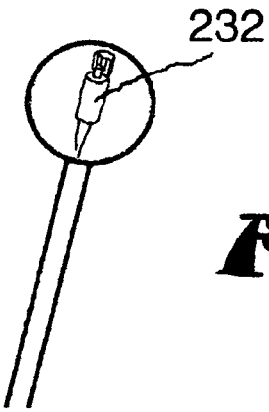
Fig.13.
Fig.14.
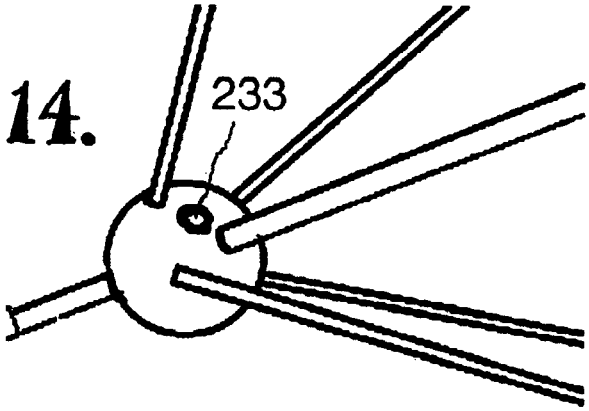

Fig.15.
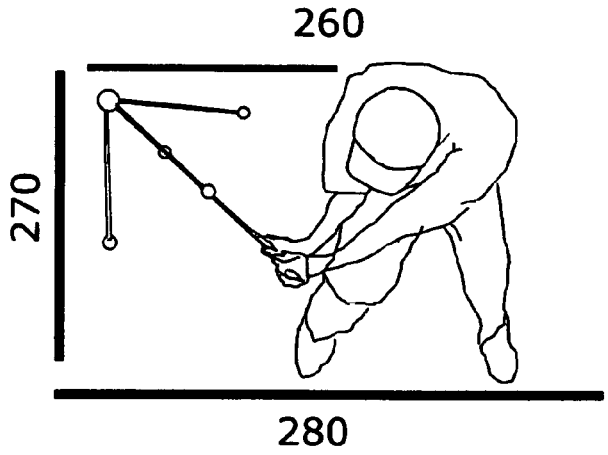
Fig.16.
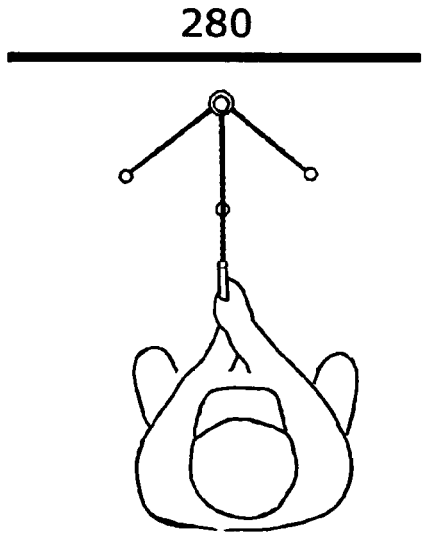
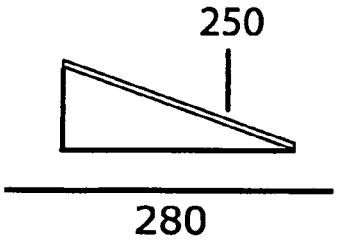
Fig.17.

GOLF SWING TRAINER APPARATUS AND METHOD

CROSS-REFERENCE TO RELATED APPLICATIONS

This application claims the benefit of U.S. Provisional Patent Application No. 60/854,610, filed Oct. 25, 2006.

BACKGROUND OF THE INVENTION

1. Field of the Invention

This invention generally pertains to gaming and sporting apparatus, and more particularly to apparatus, equipment and methods for games, sports and similar activities involving the training and improving of a player's swing for swinging a striking member and striking an unconstrained playing object, such as a golf ball.

2. Objects and Advantages

There are a number of well-known sports which include an unconstrained playing object driven by the action of a player upon the object. Typically the playing object is a ball and the player acts upon the ball by striking the ball with a striking member such as a bat. In each case, the playing object must be located in a prescribed strike zone, from which it is driven in furtherance of obtaining the goal. Examples of such sports include baseball (hardball or softball), tennis, hockey, and golf. As is generally well known, the playing object and the striking member is different in each sport, and each has different operating, behavioral and response characteristics. Furthermore, each game has its own specific sets of generally well known and easily obtained rules and regulations which control the play of the game and the actions of the player or players.

In each case, the conformation of the playing object and the methods and rules of the game vary, but the playing object must be driven at the correct speed and in the correct direction to attain the goal and win the game. This can only be accomplished by the player's correctly striking the playing object in the strike zone, whether with bat, racquet or foot. Therefore, it is extremely important that the player seek to improve the skill of correctly and accurately striking the ball. In each respective sport, there is an ideal swing pattern which is preferred as bringing about the most accurate reaction in the playing object, and the player will seek to consistently replicate this pattern. However, this result cannot be casually obtained. The act of striking the swing must be regularly practiced, and the player who attains the status of professional athlete will seek to hone this skill as an integral and important part of a successful career. The player seeking to improve his or her swing will often review printed instructional materials, whether text or photographic, which reduce the ideal swing to a series of component portions or moves. After reviewing these materials, the player will then attempt to replicate these moves.

However, it is difficult for the player to ascertain whether in fact his swing has successfully duplicated the requisite moves. Of course, it is generally critical to actually duplicate the moves and not merely to make the attempt. Therefore, some form of feedback from the practice swings is necessary so as to bring the next successive practice swing into greater conformity with the desired swing.

The game of golf is played with a relatively small, resilient ball. A player employs as a striking member a club with a striking head portion and an upwardly extending handle portion to strike the golf ball and drive the ball toward its intended goal. Each player maintains a variety of clubs, each designed to give a specific performance for driving the ball toward a green or putting the ball to the cup. The ball is to be struck while lying on the ground or on a tee, in the location of its last fall.

Training feedback, in the prior art, has been accomplished in a number of ways. The player, in some cases may be able to perform the practice swings before a mirror and observe the actual swing. While this method offers instantaneous feedback, it has several substantial disadvantages. Firstly, the player cannot concentrate on the practice swing and concentrate on observing the mirrored swing simultaneously without a real reduction in performance. Secondly, the practice swing often takes place at a high rate of speed, exceeding the ability of the human eye to correctly discern the sequence and correctness of the moves of the swing. Thirdly, the mere presence of the mirror may actually constitute a physical hazard to the player if the mirror is not sufficiently protected from the playing object when propelled by the impact of the striking member. Finally, it is typical to attempt many practice swings during a practice session, which may necessitate the use of a relatively large number of playing objects and a fair amount of time to recover the projected playing objects.

Another method of training requires the player to employ the services of an instructor or personal trainer. This method is better than the former method, since the trainer can observe the swing objectively and the player can concentrate on the practice swing entirely. However, this method still involves the use of a relatively large number of playing objects and the recovery time necessary. Also, the trainer's ability to observe the swing remains limited to the ability of the human eye to interpret the moves. There is also commonly a substantial cost factor involved in the retaining of a personal trainer, and the additional concern regarding the knowledge and qualifications of the trainer to diagnose and teach the correct swing.

The player may also elect to photograph a video record of the practice swings. This allows the player, or an instructor, to review the practice swings with a view to correctness, although this review may be difficult to conduct contemporaneously. Also, the video record may be reviewed at a reduced speed and thereby more accurately analyzed. However, as with the personal trainer, the recording and analyzing process usually involves substantial set-up and operating expense, and may also require a special location providing controlled conditions.

Another method of training involves the use of specially designed mechanical apparatus which provides feedback to the player about the swing. Such apparatus is often expensive and distracting to the player during the practice session, occasionally even hindering the training process.

Furthermore, in all of the foregoing, it is typically necessary to conduct practice sessions at either an actual playing field or a field or facility especially designed for the practice of the selected sport, which often presents difficulties because of scheduling constraints for the player and others, because of travel, or because of weather.

None of the foregoing provide any substantial immediate tactile feedback useful and desirable for immediate correcting of the swing. It is also difficult to determine whether the player has correctly placed the striking member in relation to the playing object and thereby determine the accuracy of the player's swing. Finally, the momentum and response of the ball may vary under different playing conditions, and it is desirable to emulate these conditions and to train the player's physical responses to accommodate these differences with a minimum of discomfiture and thereby to maximize the player's accuracy and power in the strike.

One training method and apparatus which overcomes several of these difficulties in training the swing for the sport of golf is disclosed in U.S. Pat. No. 5,026,064, issued to the present inventor, which discloses a golf training club and a specially adapted target resting on a playing surface. While the 064 training club has helped countless golfers to develop a better golf swing by correcting certain defects in their swings, it would be desirable to have a training device that corrected these and other swing defects to further promote a good swing. Specifically, the 064 device allowed golfer to swing either too much from the outside or inside, thereby not helping them obtain the correct swing plane. The present device corrects this error by making it impossible to stick the target unless the training clubhead has been perfectly presented to the target member at the most important point in the swing, impact. It also helps engage the golfers sense of feel and gives the golfer distinct visual checkpoints with which to check their swings.

It is therefore an object of the present invention to conveniently provide a method of practicing the swing desired for a selected sport or game.

It is another object of the present invention to provide an apparatus suitable for providing feedback of the results of the practice swing.

It is yet another object of the present invention to provide such a method and apparatus as will permit the player to safely and conveniently practice the desired swing.

It is still another object of the present invention to provide such a method and apparatus as will permit the player to obtain immediate desirable tactile feedback useful in improving each successive practice swing.

It is another object of the present invention to provide such a method and apparatus as will enable the player to improve his swing for a selected sport or game.

It is a still further object of the present invention to provide such a method and apparatus as may be employed either by the player or by the player and an instructor for the improvement of the player's swing.

It is a further object of the present invention to provide such a method and apparatus as may be inexpensively and simply employed by the player.

It is yet a further object of the present invention to provide such a method and apparatus as may be employed without requirement of a special location or playing or practice field.

It is another object of the present invention to provide such a method and apparatus as will successfully emulate in the practice swing the physical requirements of the actual swing.

It is yet another object of the present invention to provide such a method and apparatus as will provide accurate tactile feedback to the player and to train the player to rapidly adapt to changing responses of the ball in play.

It is yet a further object of the present invention to provide such a method and apparatus as will enable a player to visually determine whether the player has correctly placed the striking member in relation to the playing object and thereby determine the accuracy of the player's swing.

These and other objectives of the present invention will become apparent in the specification and claims that follow.

SUMMARY OF THE INVENTION

The subject invention is comprised of a striking member adapted to emulate a specific selected sport, such striking member having removable indicator appendages that enable the user to feel by vibration and replicate by sight where the striking member is during the striking movement, and a target member adapted to emulate the playing object of the same selected sport, the target member including flexible, elongate momentum elements selectively attachable to the target member to provide progressive resistance and accurately simulate the characteristics of an actual ball or playing object.

BRIEF DESCRIPTION OF THE DRAWINGS

FIG. 6 shows a perspective view of the short target member.

FIG. 7 shows a perspective view of the long target member.

FIG. 8 shows a perspective view of the striking member with appendages attached.

FIG. 9 shows a golfer addressing the target member with the striking member with appendages attached.

FIG. 10 shows a golfer in the backswing with the striking member with appendages attached.

FIG. 11 shows a golfer at correct impact with the target member with the striking member with appendages attached.

FIG. 12 shows an alternate of the invention attached to a normal golf club.

FIG. 13 shows how a vibratory motor could be attached or embedded in the ends of the appendages.

FIG. 14 shows a pushbutton that could be used to turn the vibratory motors on and off.

FIG. 15 shows a view above the golfer in the delivery position of the downswing with the striking member with appendages attached.

FIG. 16 is a view above the golfer at address showing how the appendages line up from there.

FIG. 17 shows the angles of the target member of the golf device. It is inclined at an angle of less than eighty degrees from perpendicular towards the target line of flight.

REFERENCED NUMERALS IN DRAWING

Figure 1:
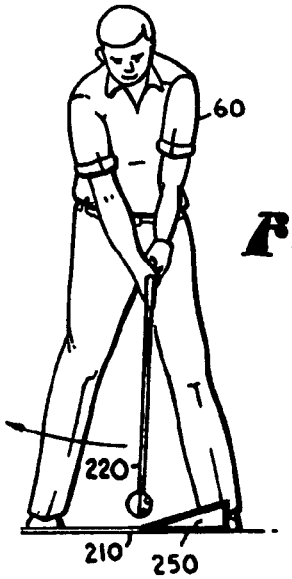
FIG. 1 shows the golfer addressing the target member with the striking member.

210 Improved golf swing training apparatus
220 Striking member
221 Shaft of striking member
222 Appendages
223 Perpendicular to ground appendage
224 Appendage on same plane as shaft
225 Appendage parallel to ground
226 Appendage left side of golfer
227 Head
228 Appendage objects
230 Normal golf club
231 Removable device
232 Vibratory motor
233 On/off button
240 Variation of striking member
250 Target member
251 Target with short momentum element attached
252 Target with long momentum element attached
253 Target surface
256 Short momentum element
256-1 Longer momentum element
260 Second line parallel to line of flight
270 Line perpendicular to line of flight
280 Line parallel to line of flight

DETAILED DESCRIPTION OF THE PREFERRED EMBODIMENT

Reference will now be made in detail to the present preferred embodiment of the invention, an example of which is illustrated in the accompanying drawings in which like reference characters refer to corresponding elements.

Figure 5:
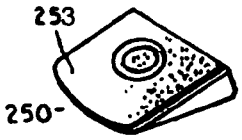
FIG. 5 shows a perspective view of the target member.

FIGS. 1 through 18 disclose an improved golf swing training apparatus 210. In these Figures, a moveable target member 250 which has a generally horizontal target surface, is shown in various views. FIG. 5 shows a perspective view, FIG. 6 shows a target member 250 with a built in momentum element 256 laid flat in trailing fashion on a playing field or a training surface. FIG. 7 shows a target member 250 with a longer 256-1 built in momentum element.

Figure 2:
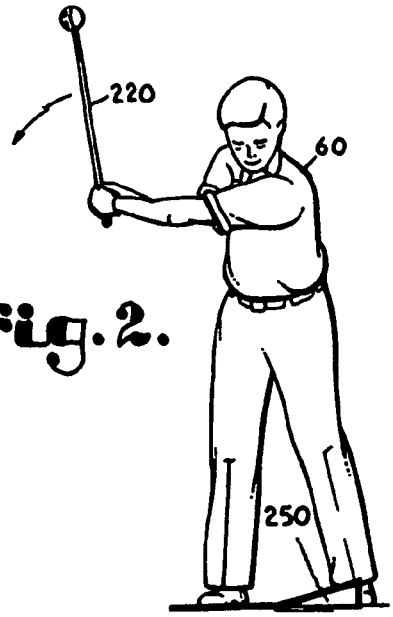
FIG. 2 shows the golfer in the backswing.
Figure 4:
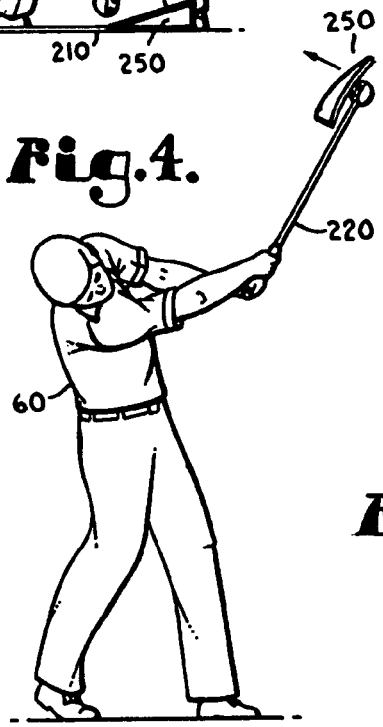
FIG. 4 shows the golfer at the finish of the swing, having connected the striking member head to the target member surface.
Figure 3:
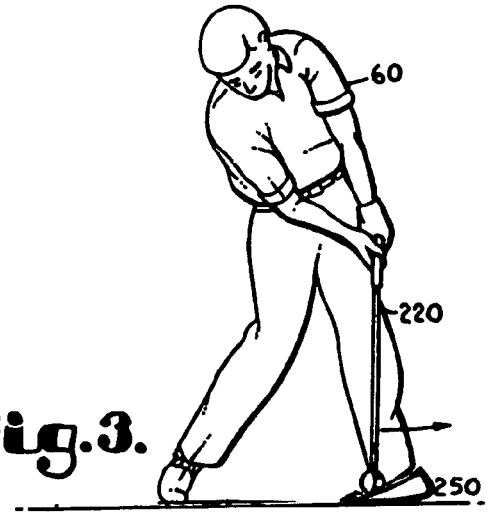
FIG. 3 shows the golfer at impact.

Turning to FIGS. 1 through 4, the operation of the golf swing training apparatus 210 is disclosed. The player 60 is shown with the striking member 220 aligning with the target member 250 disposed in the golf strike zone preparatory to initiating the swing in FIG. 2. FIG. 2 shows the player 60 moving the striking member 220 through the initial part of the swing. FIG. 3 shows the instant of impact of the striking member 220 and the target surface 252. At this point, the target member 250 begins resisting the movement of striking member 220, which is transmitted to the player 60 by way of the striking member 220, reproducing the physical sensation experienced in striking an actual golf ball. This resistance continues to be felt through the remainder of the swing, as the target member 250 is carried through the balance of the swing.

For additional resistance, additional momentum elements may be fixed by suitable fastening means to the distal end of the target member 250 of FIGS. 5, 6 and 7. The target member 250 itself is preferably constructed of foam and cloth materials, and is relatively lightweight, so that training can proceed from swings with relatively little resistance to greater resistance by simply adding to the momentum response by attaching additional momentum elements 256 or providing target members with additional momentum elements built in to them 251 in FIG. 6 or 252 in FIG. 7.

FIGS. 8 thru 14 disclose a variation 240 of the striking member 220. It has multiple appendages 222 attached to the head of the striking member 220. FIG. 8 shows four such appendages 222 attached at forty-five degree angles to the shaft of the striking member 221. They are attached to the head 227 so that if the striking member shaft 221 were held at a forty-five degree angle to the line of flight the first appendage 223 would be perpendicular to the ground. The second appendage 224 would be on the same plane as the shaft 228 and to the golfer's right side. The third appendage 225 would be parallel to the ground and on same plane formed by the shaft 228 and appendage 223 and the fourth appendage 226 would be on the same plane formed by the shaft 228 and appendage 224 and to the golfer's 60 left side. The appendages 222 have objects 228 attached to the tops of each of them. The purpose is give more feedback to the golfer 60 as to where the striking member 220 is at any point in the swing. The appendages 222 could be made from any type of plastic or fiberglass shafts.

FIGS. 9 thru 11 show how the appendages 222 can be used with the target member 250 to correct a golfer's swing at impact. FIG. 11 shows the correct impact of the striking member 220 with the target member 250 with the third appendage 225 behind the shaft 221.

FIG. 12 shows an alternative to FIG. 8 in that the appendages 222 could be incorporated into a device 231 that fastened onto a normal golf club 230 or other training device so that you could get feedback while hitting golf balls with any type of normal club 230.

FIG. 13 shows an alternative that would also help the golfer 60 to determine where the striking member 220 was while swinging by engaging the proprioceptors of the human body. It has been established that it is easier to know by feel where an object is in time and space if it is vibrating at the time that we would have control of it in our hands. Therefore, we have found it useful to embed in the appendages 222 a vibratory motor 232 similar to those used in cell phones to alert the user of an incoming call. This will cause the striking club 220 to vibrate and let the golfer 60 know where it is even though it might be out of sight in the backswing or downswing. An alternative to this is shown in FIG. 18 where just the vibratory motor 232 could be built into or attached to a normal golf club 230 or striking member 220.

Figure 18:
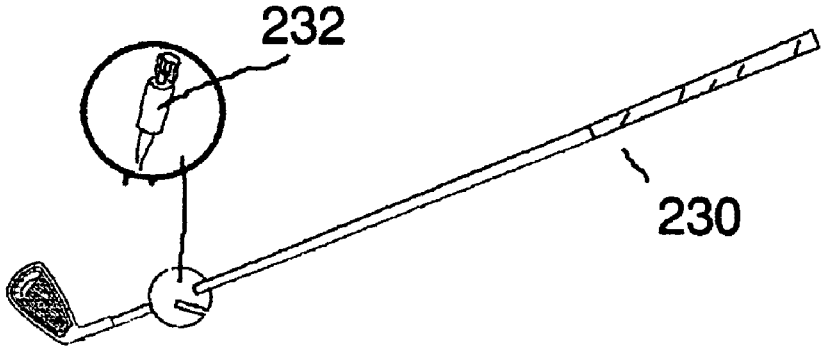
FIG. 18 shows how the vibrational member by itself could be attached to a normal club.

FIG. 14 shows an on/off button 233 and a head 227 that could contain the proper electronic power supply for the device of FIG. 8, FIG. 14 and FIG. 18.

FIG. 15 shows how the appendages 222 on the striking member 220 can help the golfer 60 to improve his swing. One of the most difficult positions for a golfer 60 to understand is that of the delivery position which is shown from above in this Figure. To understand how to get into this position, the golfer puts the second appendage 224 into a position where it is parallel to the line of flight 280 and a second line parallel to the line of flight 260 and fourth appendage 226 is perpendicular to the line of flight 270.

FIG. 18 shows how the vibrational member by itself could be attached to a normal club.

As can be seen, the various embodiments are of relatively straightforward construction, and permit the player to train conveniently and safely. Furthermore, the training apparatus provide a simple and effective means of improving the swing required in selected sport due to the instant and accurate feedback and the positive physical training provided by the present invention. The player's swing under the actual gaming conditions is substantially enhanced by the tactile feedback experienced during training, especially the accurate tactile feedback provided by the momentum element when attached to the target member during the practice session. This accurate tactile feedback enables the player in training to train for an accurate physical response to the swing. In addition, the present invention is relatively simple of manufacture and maintenance. Also, the present invention is inexpensive to use and to operate, and can be used in cooperation with other training methods to provide improved training where desired.

It will be appreciated by those skilled in the art that the target surface may bear a variety of imprints or printed targeting patterns. The principal requirement of the target surface imprint is to indicate the desired point of contact to the player, and to enable the player to determine the accuracy of the player's swing.

Modifications to the preferred embodiment of the subject invention will be apparent to those skilled in the art within the scope of the claims that follow.

What is claimed is:

1. A sports swing trainer apparatus comprising:

a striking member having a striking head portion and an upwardly extending shaft portion, said striking head portion having a contact element comprising a first fastener material;

a first target member having a ramped target surface and a base surface, said ramped target surface comprising a second fastener material, said second fastener material being removably attachable to said first fastener material, and said base surface comprising a third fastener material;

a plurality of momentum elements, each of said plurality of momentum elements having an elongated portion and a fastening surface, each fastening surface comprising a fourth fastener material, said fourth fastener material being removably attachable to said third fastener material, each of said plurality of momentum elements extending from said base surface and being aligned with said ramped target surface; and wherein, in use, said target member and one of the plurality of momentum elements rest on a playing surface and are oriented in line with a target and said ramped target surface is inclined at an angle relative to said playing surface.

2. The sports swing trainer apparatus of claim 1 wherein said striking member further comprises a plurality of appendages that are attached to said striking head portion.

3. The sports swing trainer apparatus of claim 1 wherein said target member is fabricated of foam and cloth materials.

4. The sports swing trainer apparatus of claim 3 wherein said striking member further comprises four appendages and each of said appendages has a top and is attached to said striking head portion at about a forty-five degree angle to said shaft portion.

5. The sports swing trainer apparatus of claim 4 wherein each of said appendages screws into said striking head.

6. The sports swing trainer apparatus of claim 4 wherein each of said appendages is bayonet mounted onto said striking head.

7. The sports swing trainer apparatus of claim 4 wherein an object is attached to said top of each of said appendages.

8. The sports swing trainer apparatus of claim 1 wherein said striking head portion is substantially spherical in shape.

9. The sports swing trainer apparatus of claim 1 wherein said contact element covers about half of said striking head portion.

10. The sports swing trainer apparatus of claim 1 wherein said ramped target surface bears a printed targeting circles.

11. The sports swing trainer apparatus of claim 1 wherein said ramped target surface is marked with two concentric circles.

12. The sports swing trainer apparatus of claim l wherein said target member has a substantially triangular cross sectional shape in a vertical plane that intersects with said target.

* * * * *